US009173472B2

(12) United States Patent
Forsythe et al.

(10) Patent No.: US 9,173,472 B2
(45) Date of Patent: Nov. 3, 2015

(54) ERGONOMIC MAKEUP SHIELD FOR APPLYING EYE MAKEUP AND METHODS OF USING THE SAME

(76) Inventors: Donna J. Forsythe, S. Barrington, IL (US); Richard F. W. Flett, Los Angeles, CA (US)

( * ) Notice: Subject to any disclaimer, the term of this patent is extended or adjusted under 35 U.S.C. 154(b) by 295 days.

(21) Appl. No.: 13/606,267

(22) Filed: Sep. 7, 2012

(65) Prior Publication Data

US 2014/0069448 A1 Mar. 13, 2014

(51) Int. Cl.
*A45D 44/12* (2006.01)
*A45D 40/30* (2006.01)

(52) U.S. Cl.
CPC ..... *A45D 40/30* (2013.01)

(58) Field of Classification Search
CPC ..... A45D 44/002; A45D 44/12; A45D 40/30
USPC ..... 132/319–320, 216, 333, 200; 2/267, 2/174; 128/857, 854; 602/57, 52, 74
See application file for complete search history.

(56) References Cited

U.S. PATENT DOCUMENTS

| | | | | |
|---|---|---|---|---|
| 1,850,540 | A | 3/1932 | Erickson | |
| 1,907,476 | A | 5/1933 | Ballard et al. | |
| 2,001,862 | A * | 5/1935 | Battey | 606/204.35 |
| 2,260,614 | A | 10/1941 | Freitas | |
| 2,392,377 | A * | 1/1946 | Golding | 606/204.35 |
| 3,472,242 | A * | 10/1969 | Demner | A45D 40/00 132/333 |
| D236,657 | S | 9/1975 | Reeves | |
| D255,606 | S * | 6/1980 | Garcia | D28/36 |
| 4,807,650 | A * | 2/1989 | Bliss | 132/319 |
| 4,880,019 | A | 11/1989 | Roubo | |
| 5,016,658 | A | 5/1991 | Green | |
| 5,050,624 | A | 9/1991 | Kobe et al. | |
| 5,052,417 | A | 10/1991 | Cordova | |
| 5,178,170 | A | 1/1993 | Kassai | |
| 5,311,888 | A | 5/1994 | Leigh | |
| 5,489,262 | A * | 2/1996 | Cartmell et al. | 602/57 |
| 5,901,714 | A | 5/1999 | Benkart | |
| 5,957,142 | A * | 9/1999 | Karafilis | 132/319 |
| D424,740 | S * | 5/2000 | Ono | D28/4 |
| D434,524 | S | 11/2000 | Kalafsky et al. | |
| 6,199,560 | B1 | 3/2001 | North et al. | |
| 6,305,389 | B1 | 10/2001 | Bakken | |
| D461,278 | S | 8/2002 | Takechi et al. | |

(Continued)

FOREIGN PATENT DOCUMENTS

| | | | |
|---|---|---|---|
| GB | 2065566 | * | 7/1981 |
| GB | 2240405 | * | 7/1991 |

*Primary Examiner* — Todd E Manahan
*Assistant Examiner* — Brianne Kalach
(74) *Attorney, Agent, or Firm* — Cook Alex, Ltd.

(57) ABSTRACT

An ergonomic makeup shield for use in applying eye makeup and methods of using the same are disclosed. The makeup shield has a generally planar body having a top surface and a bottom surface, the body further including at least four generally straight side, with adjacent sides being connected by generally curved corners and the sides being oriented relative to each other to provide angles between adjacent sides wherein at least two of the angles are acute angles and at least two of the angles are obtuse angles, and wherein the top surface has a perimeter that is smaller than the bottom surface and the top surface is connected to the bottom surface by a generally beveled edge extending around at least two of the generally curved corners and along the respective sides adjacent thereto. The makeup shield also may include scale indicia along at least two of the sides.

7 Claims, 4 Drawing Sheets

(56) References Cited

U.S. PATENT DOCUMENTS

| | | | | |
|---|---|---|---|---|
| D467,034 | S | 12/2002 | Jaggers | |
| 6,601,591 | B1 | 8/2003 | Carullo et al. | |
| 6,640,814 | B1 * | 11/2003 | Burke | A45D 40/30 132/319 |
| D490,932 | S | 6/2004 | Mammone | |
| 6,807,970 | B2 | 10/2004 | Thayer | |
| D519,239 | S | 4/2006 | Katagiri | |
| D629,109 | S * | 12/2010 | Phillips | D24/158 |
| D642,332 | S | 7/2011 | Kim | |
| 8,074,667 | B2 | 12/2011 | Villanueva | |
| 8,235,060 | B2 * | 8/2012 | Konrad | 132/319 |
| 2003/0094184 | A1 * | 5/2003 | Parsons | 132/319 |
| 2004/0089319 | A1 * | 5/2004 | Thayer | 132/319 |
| 2005/0155618 | A1 | 7/2005 | Lafferty | |
| 2007/0006748 | A1 * | 1/2007 | Liu | 101/127 |
| 2007/0186946 | A1 * | 8/2007 | Castleberry | 132/200 |
| 2009/0183747 | A1 | 7/2009 | Salicunaj | |
| 2010/0018542 | A1 | 1/2010 | Konrad | |
| 2010/0154813 | A1 * | 6/2010 | Deeds | 132/200 |
| 2010/0282269 | A1 | 11/2010 | Uchida et al. | |
| 2010/0326462 | A1 | 12/2010 | Dobler et al. | |
| 2011/0100392 | A1 | 5/2011 | Smith et al. | |

* cited by examiner

ERGONOMIC MAKEUP SHIELD FOR APPLYING EYE MAKEUP AND METHODS OF USING THE SAME

BACKGROUND OF THE INVENTION

1. Field of the Invention

The present invention generally relates to devices or accessories that are used in applying makeup or cosmetics, and more particularly to an ergonomic makeup shield for use in applying eye makeup to a face, and methods of using the same. This disclosure presents an example embodiment that is representative of such a device that may be utilized for particular purposes.

2. Discussion of the Prior Art

There have been many different devices used by makeup artists, cosmetologists and other individuals when applying eye makeup to a face, whether to a face of another individual or oneself. Objects such as a business card or credit card have been used, and many different makeup shield devices have been developed. Such makeup shield devices commonly include at least one concave edge, so as to be able to place the makeup shield between the lower eye lashes and the skin immediately below the eye or between the upper eye lashes and the skin of the eyelid, to protect the skin while applying mascara or other makeup. Some prior art makeup shields include a handle for grasping the device, and some include other ways of being held in place, including for instance hands-free designs that use adhesive, so as to adhere the makeup shield to the face to protect the skin around the eye. However, such devices are not particularly well suited for the application of eye liner or eye shadow and leave room for improvement.

For instance, it is somewhat common that such devices present sharp corners that could be harmful when used around an eye or against a face. Also, many provide relatively abruptly cut and thick edges, which tend to provide a place for eye makeup to clump or collect and create problems. For those devices that are intended to be adhered to the skin, this limits the ways and order in which makeup can be applied to the face because it is not practical to have a makeup shield adhered to the face in an area already bearing makeup.

The shape of prior art devices may not permit only the top surface or only the bottom surface of a device to be held against the face when applying makeup proximate the respective first and second eyes. However, having to hold against the face the respective opposed top and bottom surfaces of the device can create cleanliness issues, due to the residue that may be captured on one surface which then must be held against the face. Also, prior art devices tend to make it difficult to apply eye makeup accurately and tend to leave the user guessing when attempting to apply eye makeup to both eyes in a substantially similar pattern.

The present disclosure provides a device and methods of using the device that address shortcomings found in prior art makeup shields for applying eye makeup.

SUMMARY OF THE INVENTION

The present disclosure generally provides an example ergonomic makeup shield for applying eye makeup and methods of using the same.

In a first aspect, disclosed herein is an ergonomic makeup shield for use in applying eye makeup to a face. The makeup shield includes a generally planar body having a top surface and a bottom surface, the body further comprising at least four generally straight sides, with adjacent sides being connected by generally curved corners and the sides being oriented relative to each other to provide angles between adjacent sides wherein at least two of said angles are acute angles and at least two of said angles are obtuse angles, and wherein the top surface has a perimeter that is smaller than the bottom surface and the top surface is connected to the bottom surface by a generally beveled edge extending around at least two of the generally curved corners and along the respective sides adjacent thereto.

In a second aspect, disclosed herein is an ergonomic makeup shield for use in applying eye makeup to a face, with the makeup shield including a generally planar body having at least four generally straight sides, with adjacent sides being connected by generally curved corners and the sides being oriented relative to each other to provide angles between adjacent sides wherein at least two of said angles are acute angles and at least two of said angles are obtuse angles, and wherein at least two of said sides include scale indicia.

In a third aspect, disclosed herein is a method of using an ergonomic makeup shield to apply eye makeup to a face. The method includes the step of providing a makeup shield having a generally planar body having a top surface and a bottom surface, the body further comprising at least four generally straight sides, with adjacent sides being connected by generally curved corners and the sides being oriented relative to each other to provide angles between adjacent sides wherein at least two of said angles are acute angles and at least two of said angles are obtuse angles, and wherein the top surface has a perimeter that is smaller than the bottom surface and the top surface is connected to the bottom surface by a generally beveled edge extending around at least two corners and along the respective sides adjacent thereto. The method further includes the steps of holding the makeup shield in a position against the face that locates the generally beveled edge opposite the face and with a first of the at least two acute angles being disposed proximate an inner corner of a first eye, applying eye makeup to the face proximate the first eye, moving the makeup shield away from the face, holding the makeup shield in a position against the face that locates the generally beveled edge opposite the face and with a second of the at least two acute angles being disposed proximate an inner corner of a second eye, applying eye makeup to the face proximate the second eye, and moving the makeup shield away from the face.

Thus, the present disclosure presents an example of an ergonomic makeup shield for use in applying eye makeup and methods of using the same that overcome disadvantages of the prior art and may be used to safely and conveniently provide clean, accurate application of eye makeup, while being easily stowable.

It is to be understood that both the foregoing general description and the following detailed description are exemplary, provided for purposes of explanation only, and are not restrictive of the subject matter claimed. Further features and objects of the present disclosure will become more fully apparent in the following description of the example and from the appended claims.

BRIEF DESCRIPTION OF THE DRAWINGS

In describing the preferred example, reference is made to the accompanying drawing figures wherein like parts have like reference numerals, and wherein.

It should be understood that the drawings are not to scale. While some details of an ergonomic makeup shield for applying eye makeup and other plan and section views of the example are not shown, such details are considered to be within the comprehension of those skilled in the art in light of the present disclosure. Terms relating to directions, such as right and left or top and bottom are used herein for convenience in providing the disclosure and are not intended to be limiting. It also should be understood that the present disclosure is not limited to the example illustrated.

DETAILED DESCRIPTION

Figure 1:
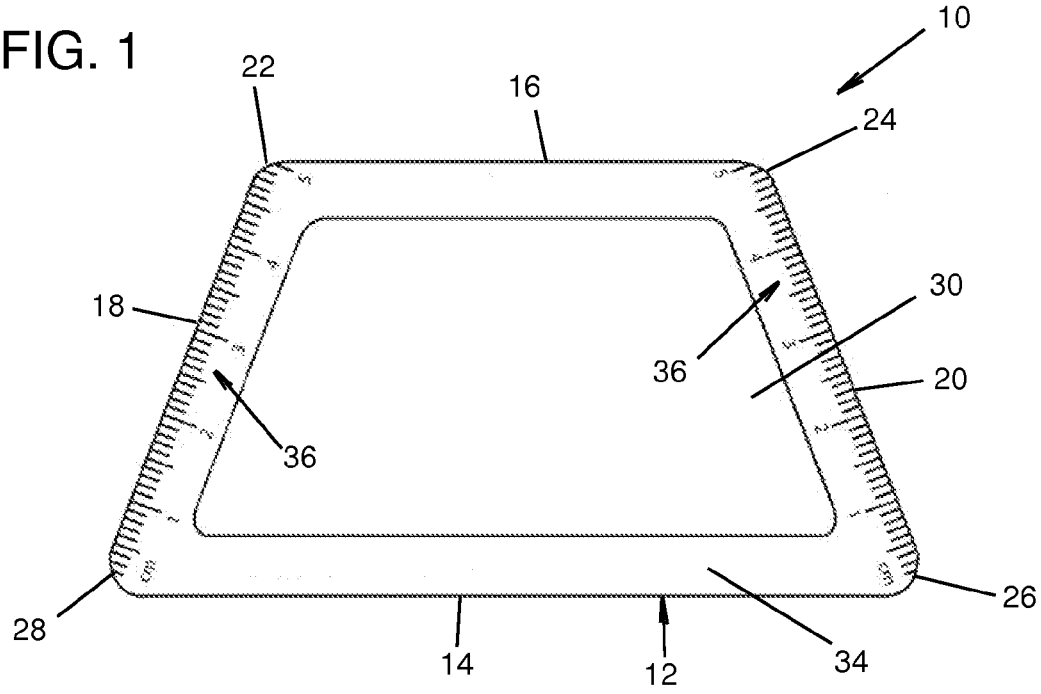
FIG. 1 is a top plan view of an example makeup shield of the disclosure.
Figure 2:
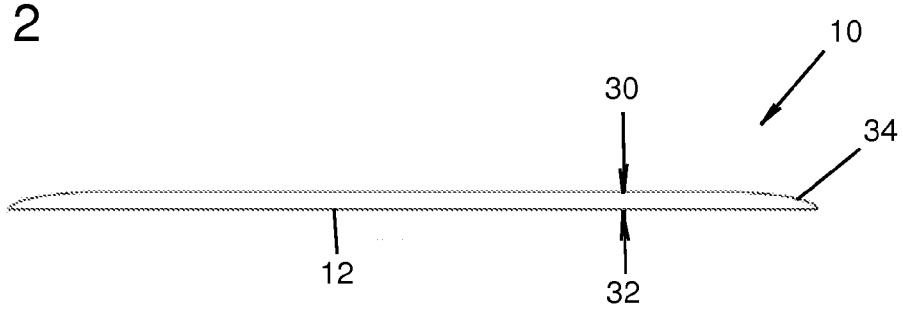
FIG. 2 is a side view of the example shown in FIG. 1.

This disclosure presents an example of an ergonomic makeup shield for applying eye makeup and methods of using the same. For instance, an example makeup shield is shown in a plan view (see FIG. 1), a side view (see FIG. 2) and then in use with respect to the application of eyeliner to a face proximate the first (right) and second (left) eyes (see FIGS. 3-6), as well as to the application of eye shadow to a face proximate the first (right) eye (FIG. 7). It will be appreciated that certain aspects of the example could be different, such as for example, the material used to construct the makeup shield, the surface finishes, the length, width and thickness of the makeup shield, the angles between adjacent sides, the specific shape of the generally curved corners, the shape of the generally beveled edge, as well as the scale indicia or the inclusion of graphics applied to either the top and/or bottom surface or generally beveled edge of the makeup shield. Thus, it will be appreciated that the ergonomic makeup shield of the present disclosure may include variations and may be used in different methods of applying eye makeup, as desired by particular users.

Turning to FIGS. 1-7, an example of an ergonomic makeup shield 10 for use in methods of applying eye makeup is illustrated. The example makeup shield 10 includes a body 12, which is generally planar and preferably has an overall length of approximately 4 inches, an overall width of approximately 2⅛ inches, and an overall thickness of approximately 1/16 inch.

The shape of the body 12 preferably is generally trapezoidal, although as shown with the body 12 of the example, it may have a symmetrical trapezoidal shape. The body 12 of the example is shown with a longer first side 14 having a length of approximately 4 inches, a shorter second side 16 having a length of approximately 2½ inches and being parallel to the first side 14, and angled third and fourth sides 18, 20, respectively, having lengths of approximately 2 inches and being at an acute angle of approximately 69 degrees to the longer first side 14 and at an obtuse angle of approximately 111 degrees to the shorter second side 16. The corners formed at the intersection of the respective sides may be generally curved and are shown in the example with a rounded shape, with corners 22, 24 accommodating the 111 degree obtuse angles between respective adjacent sides, and corners 26, 28 accommodating the 69 degree acute angles between respective adjacent sides. The sides 14, 16, 18, 20 are generally straight, which helps facilitate accurately creating or forming straight edges when applying makeup to the face. Thus, the makeup shield 10 may be placed against the face F and used as a guide, alleviating the need for a very steady hand that would otherwise apply makeup in a freehand manner.

The body 12 of the example makeup shield 10 has a top surface 30 and a bottom surface 32. The top surface 30 has a smaller surface area and perimeter than the surface area and perimeter of the bottom surface 32. A generally beveled edge 34 extends between and connects the perimeter of the top surface 30 to the perimeter of the bottom surface 32, and advantageously extends around at least two generally curved corners and along the respective sides adjacent thereto. The generally beveled edge 34 includes a slope that in the example is somewhat curved, but could be linear or have other shapes. The generally beveled edge 24 enables the makeup shield 10 to be held in a flush position proximate the inner and outer corners of an eye.

The dimensions, shapes and angles noted are advantageous for several reasons that will be appreciated within the further description, but may be varied while still being within the scope of the appended claims. The makeup shield 10 is relatively thin and light weight, making it convenient to grasp and to manipulate in the hand of a user, such as by holding it between the thumb and first finger. In this sense the makeup shield 10 is user friendly and can be used in different ways, depending on how a user positions the makeup shield between fingers and how the user positions the hand and wrist. This can be helpful when placing the makeup shield 10 against the face F or otherwise handling the makeup shield 10. The generally curved corners 22, 24, 26, 28 of the body 12 permit safe and comfortable placement of the makeup shield 10 proximate or near an eye, alleviating poking or gouging concerns. The smaller acute angled corners 22, 24 are particularly well suited for use adjacent an inner corner of an eye, between the eye and the nose.

During use, the generally beveled edge 34 is intended to be held opposite the face F, so as to be facing away from the face F, and may provide the following advantages: 1) it allows the makeup shield 10 to be held flush to the face; 2) it eliminates what would otherwise be presented as a thick edge or ledge, thereby removing the likelihood that residue or debris that falls from the face will collect on the makeup shield edge and against the face where it might form clumps along the skin, so as to instead allow residue or debris to cleanly fall away from the eye and face; 3) by being present around at least a generally curved corner and along the respective sides adjacent thereto, it is well suited for use proximate an inner or outer corner of the eye, such as between the eye and nose to prevent residue or debris from collecting on any card edges, allowing the makeup shield to be more cleanly repositioned or rotated during makeup application; and 4) it can be used for accurately applying makeup whether in straight lines or along the generally curved corners.

The generally trapezoidal shape permits the makeup shield 10 to be "even handed", meaning the makeup shield 10 may be used in an upward facing orientation, with the generally beveled edge 34 facing away from the face F, so as to provide a number of the above-mentioned advantages and remains facing away from the face F while being used on either first eye FE or second eye SE. This can be particularly beneficial with respect to reducing the likelihood of makeup residue or debris being inadvertently transferred to the face F or to the user's hand when the makeup shield 10 is being repositioned for use proximate the same eye or proximate the opposite eye. This also may reduce the number of times the makeup shield 10 must be cleaned during use.

The overall size and generally trapezoidal shape of the makeup shield 10 permit the device to be conveniently grasped by a user and to cover a sufficient area during use to protect the cheek and areas below the eye from falling residue or debris. They also allow the makeup shield 10 to be easily stowable, by placing the makeup shield 10 in a relatively thin stowing receptacle, such as in a pocket of a shirt, apron or pants, or in a wallet, makeup bag or case. Indeed, the generally trapezoidal shape presents at least two acute leading generally curved corners 26, 28 for more convenient initial location within a stowing receptacle, and the acute angle formed by the adjacent sides provides a draft angle which tends to open the receptacle and self-center the makeup shield 10 within the receptacle, while permitting easier insertion. The generally trapezoidal shape also offers at least two different corner angles, including at least two acute and at least two obtuse angled corners, while also effectively offering straight or linear sides having at least three different lengths. The straight sides 14, 16, 18, 20, essentially may be used universally, regardless of the specific shape of an eye. This is advantageous when compared to the above-mentioned prior art devices that include a side with a built-in specific concave curve which may fit some eye shapes, but undoubtedly will create issues when not properly fitting a particular eye shape.

The makeup shield 10 preferably is constructed as a single piece that may be made of plastic or rubber, in an easily cleanable and reusable form, or of paperboard or other fibrous material, in a single-use disposable form. The surface finishes of the top and bottom surfaces 30, 32 and the generally beveled edge 34 may range from smooth to rough, as desired. The surface finishes may affect the ability to grasp the makeup shield 10 and the ability for the makeup shield 10 to hold falling residue or debris. It will be appreciated that one or both of the top and bottom surfaces 30, 32 also may include molded-in shapes (not shown), such as to enhance the grip when holding the makeup shield 10 between fingers. The makeup shield 10 also preferably is planar and semi-rigid, which allow it to be easily grasped, but pliable enough to allow it to bend somewhat, so as to help conform to the contours of the face.

The makeup shield 10 can include graphics, whether formed into the top or bottom surfaces 30, 32 or the generally beveled edge 34, or applied thereto, such as by printing on one or more of the respective surfaces. For instance, scale indicia 36 is provided along the two angled sides 18, 20. Scale indicia 36, such as in the form of graduated markings that are similar to those found on a ruler or of another spaced format, may be used to more accurately apply eye makeup while creating straight edges, and is particularly advantageous when seeking to apply makeup in a substantially similar pattern to both eyes, as seen, for example, in FIGS. 3 and 4, when forming a winged-out or cat eye eyeliner look. While the scale indicia is shown along the sides 18, 20 on the example makeup shield 10, in FIGS. 1, 3 and 4, it will be appreciated that, if desired, it could be provided along the additional sides, such as sides 14, 16, as well as around the generally curved corners 22, 24, 26, 28.

Figure 3:
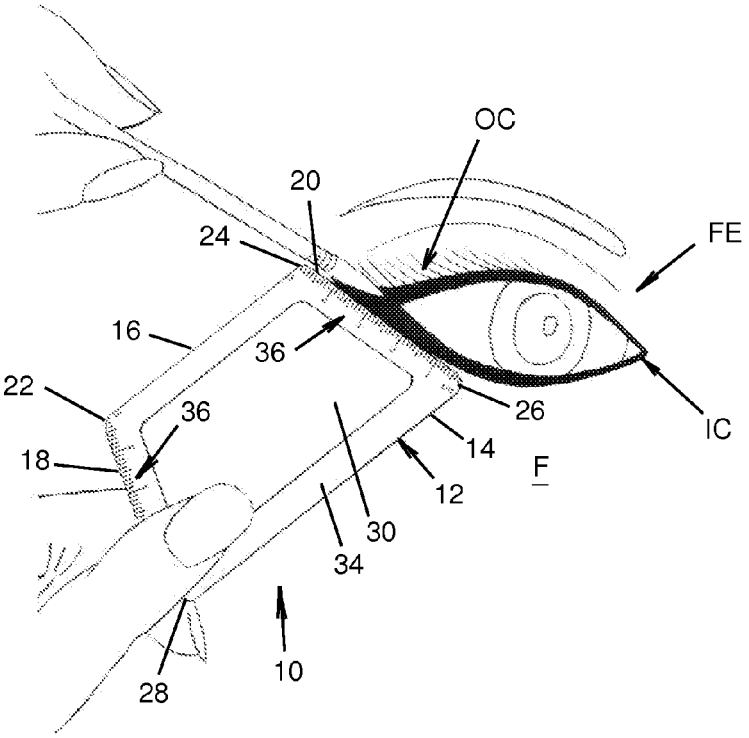
FIG. 3 is a plan view of the example shown in FIGS. 1-2 being used to apply eye makeup to a face and more particularly to apply eyeliner proximate a first or right eye.
Figure 4:
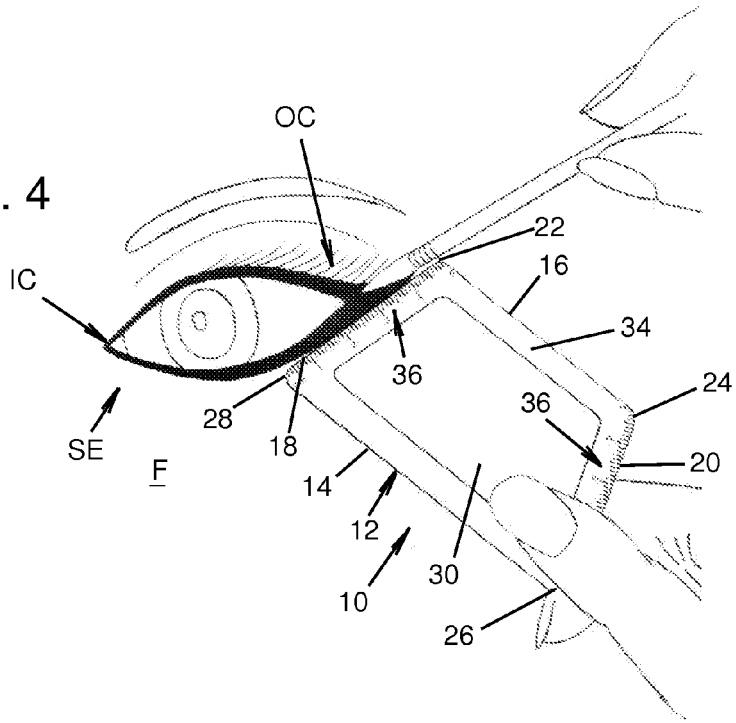
FIG. 4 is a plan view of the example shown in FIGS. 1-2 being used to apply eye makeup to a face and more particularly to apply eyeliner proximate a second or left eye.
Figure 5:
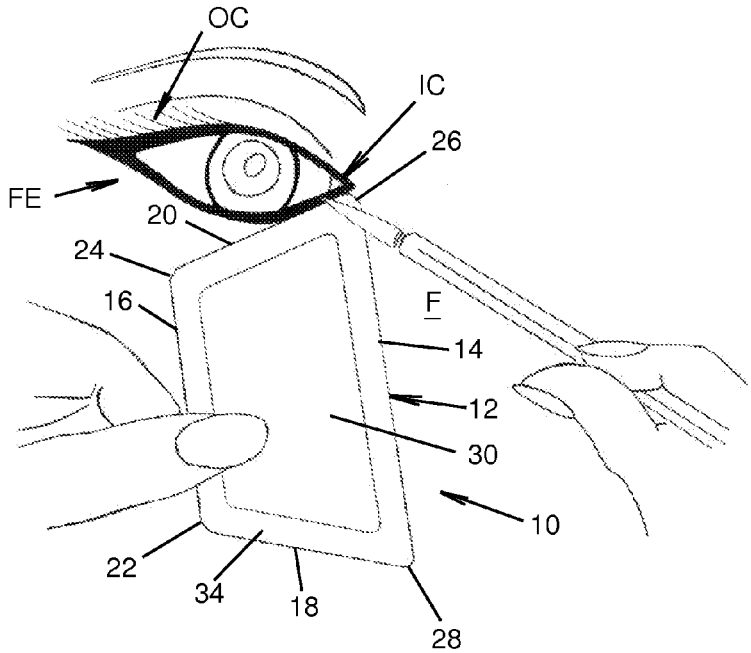
FIG. 5 is a plan view of the example shown in FIGS. 1-2 being used to apply eye makeup to a face and more particularly to apply eyeliner proximate the first or right eye, with the makeup shield being shown without scale indicia for ease of viewing.
Figure 6:
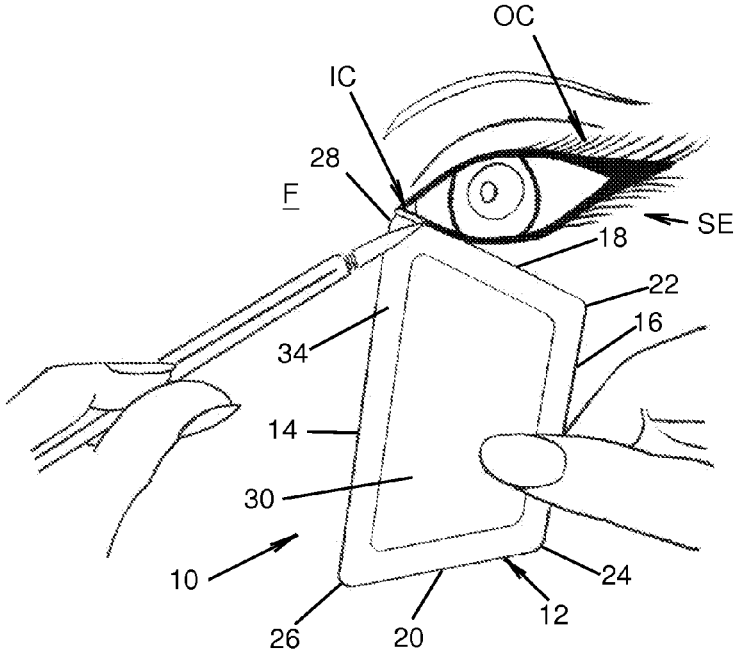
FIG. 6 is a plan view of the example shown in FIGS. 1-2 being used to apply eye makeup to a face and more particularly to apply eyeliner proximate the second or left eye, with the makeup shield being shown without scale indicia for ease of viewing.
Figure 7:
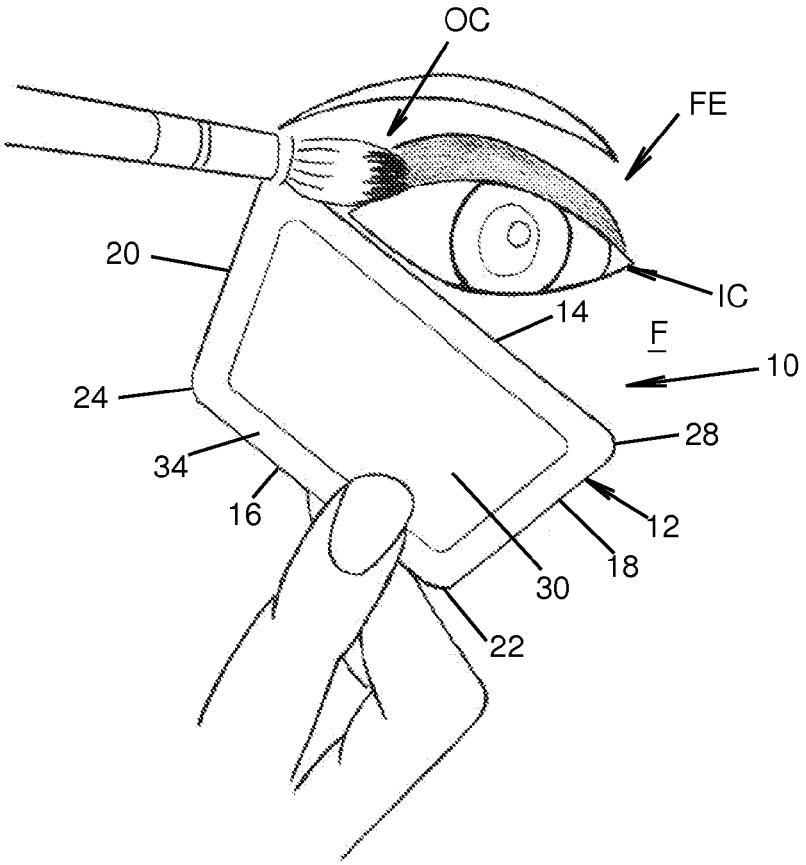
FIG. 7 is a plan view of the example shown in FIGS. 1-2 being used to apply eye makeup to a face and more particularly to apply eye shadow proximate the first or right eyelid, with the makeup shield being shown without scale indicia for ease of viewing.

FIGS. 2-7 illustrate methods of using the example ergonomic makeup shield 10 to apply eye makeup to a face. For instance, FIGS. 5-6 show a method of use of an ergonomic makeup shield 10 that includes providing a makeup shield 10 having a generally planar body 12 having a top surface 30 and a bottom surface 32, the body 12 further comprising at least four generally straight sides, 14, 16, 18, 20, with adjacent sides being connected by generally curved corners and the sides being oriented relative to each other to provide angles between adjacent sides wherein at least two of said angles are acute angles and at least two of said angles are obtuse angles, and wherein the top surface 30 has a perimeter that is smaller than the bottom surface 32 and the top surface 30 is connected to the bottom surface 32 by a generally beveled edge 34 extending around at least two corners and along the respective sides adjacent thereto. As may be seen in FIG. 5, the method further includes holding the makeup shield 10 in a position against the face F that locates the generally beveled edge 34 opposite the face F and with a first of the at least two acute angles (between sides 14 and 20) being disposed proximate an inner corner IC of a first eye FE, applying eye makeup to the face F proximate the first eye FE, and then moving the makeup shield 10 away from the face F. The method further includes holding the makeup shield 10 in a position against the face F that locates the generally beveled edge 34 opposite the face F and with a second of the at least two acute angles (between sides 14 and 18) being disposed proximate an inner corner IC of a second eye SE, applying eye makeup to the face F proximate the second eye SE, and moving the makeup shield 10 away from the face F.

It will be appreciated that the method described may be used when applying eye liner, as shown in FIGS. 5-6, or alternatively shown with application of eye liner to the outer corners OC of the first eye FE and second eye SE, as shown in FIGS. 3-4. Still further a similar method of applying eye makeup may be used to apply eye shadow, as shown for example in FIG. 7. The makeup shield 10 allows one to accurately apply eye makeup including to create a straight edge on the face F with the makeup proximate the first eye FE or second eye SE, as shown for example in FIGS. 3 and 4.

In addition, it will be appreciated that the method may include using a makeup shield having scale indicia 36 along at least two of the at least four generally straight sides, such as sides 18, 20 of sides 14, 16, 18, 20. As shown, for example in FIGS. 3-4, the method may then include holding the makeup shield 10 in a position against the face F that locates one of the at least two sides that include scale indicia 36 proximate the first eye FE (see FIG. 3) and applying makeup to the face F proximate the first eye FE and noting the location of the makeup relative to the first eye FE and to the scale indicia 36 on the one of the at least two sides that include scale indicia 36, moving the makeup shield 10 away from the face F, holding the makeup shield 10 in a position against the face F that locates a second of the at least two sides that include scale indicia 36 proximate the second eye SE (see FIG. 4), applying makeup to the face F proximate the second eye SE and noting the location of the makeup relative to the second eye SE and to the scale indicia 36 on the second of the at least two sides that include scale indicia 36, and moving the makeup shield away from the face F. Such a method that includes using the scale indicia 36 to apply the makeup may facilitate applying eye makeup to the face F in a substantially similar pattern proximate the first and second eyes FE, SE, such as is shown in FIGS. 3-4. Thus, the scale indicia 36 can be used to effectively measure, compare and duplicate the makeup applied to the first eye FE when applying makeup to the second eye SE.

In light of the above discussion, the drawings and the attached claims, it will be appreciated that ergonomic makeup shields and methods of using them to apply eye makeup to a face in accordance with the present disclosure may be provided in various configurations. A variety of suitable materials of construction and alternatives with respect to dimensions, shapes and other attributes, as well as other methods of applying eye makeup may be utilized to meet the particular needs and requirements of a user. It will be apparent to those skilled in the art that various modifications can be made in the design and construction of such ergonomic makeup shields, and in the performance of such methods, without departing from the scope of the attached claims, and that the claims are not limited to the preferred example illustrated.

We claim:

1. A method of using an ergonomic makeup shield to apply eye makeup to a face comprising the steps of:

providing a makeup shield comprising a generally planar body being at least semi-rigid and having a top surface and a bottom surface, the body further comprising at least four straight sides, with adjacent said straight sides being connected by curved corners and said straight sides being oriented relative to each other to provide angles between adjacent said straight sides wherein at least two of said angles are acute angles and at least two of said angles are obtuse angles, and wherein the top surface has a perimeter and the bottom surface has a perimeter, wherein the perimeter of the top surface is smaller than the perimeter of the bottom surface and the top surface is connected to the bottom surface by a generally beveled edge extending around all of said curved corners and along all of said straight sides therebetween, wherein scale indicia is provided along at least two of said straight sides;

holding the makeup shield in a position against the face that locates the generally beveled edge opposite the face and with a first of the at least two of said straight sides having scale indicia being disposed adjacent a first eye;

applying eye makeup to the face adjacent the first eye and along the first of the at least two said straight sides having scale indicia to a point;

moving the makeup shield away from the face;

holding the makeup shield in a position against the face that locates the generally beveled edge opposite the face and with a second of the at least two of said straight sides having scale indicia being disposed adjacent a second eye;

applying eye makeup to the face adjacent the second eye and along the second of the at least two said straight sides having scale indicia to a point; and moving the makeup shield away from the face.

2. The method of using an ergonomic makeup shield of claim 1 wherein the steps of applying makeup to the face adjacent the first and second eyes includes applying eyeliner.

3. The method of using an ergonomic makeup shield of claim 1 wherein the steps of applying makeup to the face adjacent the first and second eyes further comprise a step of applying eye shadow.

4. The method of using an ergonomic makeup shield of claim 1 wherein the step of applying makeup to the face adjacent the first eye includes locating a first of said at least two acute angles adjacent an inner corner of the first eye.

5. The method of using an ergonomic makeup shield of claim 1 wherein the step of applying makeup to the face adjacent the second eye includes locating a second of said at least two acute angles adjacent an inner corner of the second eye.

6. The method of using an ergonomic makeup shield of claim 1 wherein the steps of applying makeup to the face adjacent the first and second eyes further comprise;

applying makeup to the face adjacent the first eye and noting the location of the makeup relative to the first eye and to the scale indicia on the one of the at least two said straight sides that include scale indicia; and applying makeup to the face adjacent the second eye and noting the location of the makeup relative to the second eye and to the scale indicia on the second of the at least two said straight sides that include scale indicia.

7. The method of using an ergonomic makeup shield of claim 6 wherein the steps of applying makeup to the face proximate the first and second eyes include using the scale indicia to apply makeup to the first and second eyes in a substantially similar pattern.

* * * * *